US008208130B2

(12) United States Patent
McConville et al.

(10) Patent No.: US 8,208,130 B2
(45) Date of Patent: Jun. 26, 2012

(54) LASER DESIGNATOR AND REPEATER SYSTEM FOR SENSOR FUZED SUBMUNITION AND METHOD OF OPERATION THEREOF

(75) Inventors: Richard P. McConville, Melrose, MA (US); Ralph Nardone, Billerica, MA (US)

(73) Assignee: Textron Systems Corporation, Wilmington, MA (US)

( * ) Notice: Subject to any disclaimer, the term of this patent is extended or adjusted under 35 U.S.C. 154(b) by 1116 days.

(21) Appl. No.: 10/548,028

(22) Filed: Apr. 25, 2006

(65) Prior Publication Data

US 2012/0050714 A1 Mar. 1, 2012

Related U.S. Application Data

(63) Continuation-in-part of application No. 11/052,520, filed on Feb. 7, 2005, now Pat. No. 7,436,493.

(51) Int. Cl.
*G01C 3/08* (2006.01)

(52) U.S. Cl. ..... 356/5.01; 356/3.01; 356/3.1; 356/4.01; 356/4.1; 356/5.1

(58) Field of Classification Search ..... 356/3.01–3.15, 356/4.01–4.1, 5.01–5.15, 6–22, 28, 28.5
See application file for complete search history.

(56) References Cited

U.S. PATENT DOCUMENTS

| | | | | |
|---|---|---|---|---|
| 4,583,703 | A | 4/1986 | Kline | 244/3.24 |
| 4,635,553 | A | 1/1987 | Kane | 102/384 |
| 6,163,372 | A * | 12/2000 | Sallee et al. | 356/5.1 |
| 6,262,800 | B1 * | 7/2001 | Minor | 356/139.07 |
| 6,666,145 | B1 | 12/2003 | Nardone et al. | 102/489 |
| 6,820,341 | B2 | 11/2004 | Snider | 30/513 |
| 6,820,531 | B1 | 11/2004 | Cianciolo | |
| 2003/0076485 | A1 | 4/2003 | Ruff et al. | |
| 2004/0004707 | A1 * | 1/2004 | DeFlumere | 356/4.01 |

* cited by examiner

*Primary Examiner* — Thomas Tarcza
*Assistant Examiner* — Luke Ratcliffe
(74) *Attorney, Agent, or Firm* — Onello & Mello LLP

(57) ABSTRACT

In a sensor-fuzed munition system and method, the munition is provided with an additional laser designator/repeater mode of operation. In the laser designator/repeater mode, the munition has the option of initiating a target strike additionally based on whether a laser appointer energy is detected as being present on the target. The laser appointer energy signal is generated at a wavelength that is consistent with the wavelength of the laser rangefinder of the munition, and is generated based on the detected presence of a designator signal at a designator spot on the target. The laser appointer signal is directed to the designator spot and detected by the munition laser rangefinder receiver. In one embodiment, the repeater system for detecting the designator signal and for generating the appointer signal is provided on the delivery vehicle for the submunition. This additional mode of operation is preferably achieved using the existing laser receiver of the rangefinder hardware, with minimal additional hardware and software systems for detecting and processing the additional laser appointer signal energy. In this manner, collateral damage and false-target firings are decreased to near-zero probability.

37 Claims, 8 Drawing Sheets

LASER DESIGNATOR AND REPEATER SYSTEM FOR SENSOR FUZED SUBMUNITION AND METHOD OF OPERATION THEREOF

RELATED APPLICATIONS

This application is a continuation-in-part of U.S. Ser. No. 11/052,520, filed Feb. 7, 2005 now U.S. Pat. No. 7,436,493, the contents of which are incorporated herein by reference, in their entirety.

BACKGROUND OF THE INVENTION

Sensor-fuzed munitions are a class of air-to-ground "smart weapons" that use the body dynamics of a projectile, or "munition", to continuously translate the instantaneous sensor field of view to thoroughly search the suspected target area. A munition is placed in motion over a region of interest. Such motion may be induced in a number of different ways, for example, by ejecting the munition from a propulsion vehicle such as a missile, by dropping the munition from an aircraft, or by launching the munition from a ground-based launch system canister such as a wide-area munition (WAM) launch system, for example, of the type disclosed in U.S. Pat. No. 6,820,341, incorporated herein by reference. Other systems and methods for munition extraction are disclosed in U.S. Pat. No. 6,666,145, incorporated herein by reference. The munitions can be dispensed individually, or a plurality of munitions, i.e. "submunitions", can be scattered from a common delivery vehicle in a cluster pattern to blanket a target area. During flight of each munition, on-board "sensors" scan for targets within the region of interest and, if a target is located, that information is used to "fuze", or activate, a warhead on the munition when the warhead is aimed at the target; hence the name "sensor-fuzed" munition.

Upon dispensing, the munition is at a given altitude and is caused to spin. As it descends from that altitude, over the region of interest, on-board sensors and corresponding processors are activated and instructed to search along the circumference of a conical scan pattern for "target-like" objects that meet the sensor algorithm criteria. The offset angle of the scan beam of the scanning instruments to the line of flight remains approximately the same during the flight. Revolution of the munition at a constant offset angle about a vertical trajectory axis, combined with the continuous descent of the munition, causes the radius of the search pattern at the intersection of the scan cone and the ground to continuously decrease, such that the scanning operation of the region of interest follows an inward spiral pattern. Deceleration technology and spin-inducing technology can be employed to arrest the ballistic path of the munition. Such technology includes a Samara wing, as disclosed in U.S. Pat. Nos. 4,583,703 and 4,635,553, incorporated herein by reference. Other deceleration and spin-inducing technologies include a parachute systems and hinged-mass systems that include an offset mass that cause the munition to spin at the offset angle about the axis of the direction of fall or simply inducing the dynamics by the action of dispense without any other decelerator or cone inducing mechanism as is done in the USAF Sensor Fuzed Weapon and the US Army Hornet.

On-board sensor systems for conventional sensor-fuzed munitions include a dual-mode infrared sensor and a laser rangefinder. The infrared sensor is a passive sensor that receives infrared energy from the background and target-like objects located in the field of view. The collected infrared data is used to search for targets that algorithmically match defined infrared signature parameters. The laser rangefinder provides a height profile to the target algorithm for improved aim point selection and greater lethality. The laser rangefinder is an active sensor including a laser transmitter that emits a laser pulse for each successive incremental foot of observation in the direction of the scan. A reflection of the transmitted pulse is received at a laser receiver and the time-of-flight of the, as reflected by the ground or the target, is measured. Processors coupled to the sensors analyze received sensor data to determine whether a target is present within the scanned region. A decision is reached by the processors, based on the sensor data and the algorithm applied, whether to trigger a stand-off warhead on the munition, such as an explosively formed penetrator (EFP), to strike the targeted object with a high-speed projectile.

Conventional applications of sensor-fuzed munition technology include the USAF Sensor Fuzed Weapon (SFW), the US Army "Hornet" off-route mine, the US Army Sense And Destroy (SADARM) 155 mm artillery projectile, the German "Smart 155" 155 mm projectile and the Swedish/French "BONUS" 155 mm projectile. While these applications have proven effective in searching for and attacking enemy target vehicles, uncertainty in the application of the detection criteria of the conventional sensor-fuzed munition to military targets and civilian vehicles is still very high. This target uncertainty is undesirable in modern warfare where minimization of collateral damage and decrease in the likelihood of engagement of an other-than-intended target(s) are of utmost concern.

SUMMARY OF THE INVENTION

The present invention is directed to a sensor-fuzed munition system and method in which the munition is provided with an additional "laser designator" mode of operation. In the laser designator mode, the munition has the option of initiating a target strike additionally based on whether laser designator energy is detected as being present on the target. This additional mode of operation is preferably achieved using the existing laser receiver of the rangefinder hardware, with minimal additional hardware and software systems for detecting and processing the additional laser designator signal energy. In this manner, collateral damage and false-target firings are decreased to near-zero probability.

In a first aspect, the present invention is directed to an autonomous munition. The munition includes a rangefinder and an illumination module. The rangefinder includes a laser transmitter that transmits a first laser energy to the ground and eventually scans over and illuminates a remote target. A laser receiver receives a reflected portion of the first laser energy as reflected by the ground and eventually the remote target within a scanned field of view of the laser receiver. It also receives a reflected portion of a second laser designator energy as reflected by the remote target within the scanned field of view of the laser receiver. A range module determines a range of the remote target from the reflected portion of the first laser energy. An illumination module determines whether the reflected portion of the second laser energy is present within the scanned field of view of the laser receiver.

In one embodiment, the laser transmitter and laser receiver comprise a rangefinder for determining the range of the munition with respect to the target. In another embodiment, the illumination module comprises a filter circuit that passes energy within an expected frequency band of the second laser energy. In another embodiment, the second laser energy is modulated and the illumination module includes a circuit that discriminates the second laser energy to determine whether the defined modulation in the second laser energy is present. The second laser energy may be amplitude modulated, phase modulated, or frequency modulated.

In another embodiment, the second laser energy is sourced from a ground location. In another embodiment, the scanned field of view of the laser receiver translates in an inward-spiral scan pattern during operation of the munition. The inward-spiral scan pattern has an inter-scan spacing between adjacent spiral scan segments. The second laser energy is incident at the remote target and illuminates a spot of a width that is larger than the inter-scan spacing.

In another embodiment, the munition further includes a warhead that is activated, in response to whether the reflected portion of the second laser energy is present within the scanned field of view of the laser receiver.

In another embodiment, the munition further includes a passive infrared receiver that receives infrared energy emitted by the remote target within a scanned field of view of the infrared receiver.

In another aspect, the present invention is directed to a method for engaging a munition with a target. First laser energy is transmitted within a transmission field of view. A reflected signal is received including a reflected portion of the first laser energy as reflected by a remote target within a receiver field of view. The remote target is illuminated with a second laser energy. It is determined whether the reflected signal further includes a reflected portion of the second laser energy as reflected by the remote target within the receiver field of view.

In one embodiment, the target is engaged as a result of the step of determining that the second laser energy is within the receiver field of view. In another embodiment, engaging the target comprises engaging the target when it is determined that the reflected signal includes the second laser energy. In another embodiment, engaging the target comprises engaging the target with a warhead.

In another embodiment, the method further comprises modulating the second laser energy for illuminating the remote target. In another embodiment, determining comprises discriminating the second laser energy using a band-pass filter that is centered at a frequency equal to that of a modulation frequency of the second laser energy. In another embodiment, the method further comprises amplitude-modulating, phase-modulating, or frequency-modulating the second laser energy.

In another embodiment, the receiver field of view translates in an inward-spiral scan pattern during operation of the munition. The inward-spiral scan pattern has an inter-scan spacing between adjacent spiral scan segments. In this case, illuminating comprises illuminating the remote target with the second laser energy of a spot size of a width that is larger than the inter-scan spacing.

In another embodiment, the method further comprises receiving an infrared signal at a passive infrared receiver including infrared energy emitted by the remote target within a scanned field of view of the infrared receiver.

The present invention is further directed to a sensor-fused munition system and method in which the munition is provided with an additional laser designator/repeater mode of operation. In the laser designator/repeater mode, the munition has the option of initiating a target strike additionally based on whether a laser appointer energy signal is detected as being present on the target. The laser appointer energy signal is generated at a wavelength that is consistent with the wavelength of the laser rangefinder of the munition, and is generated based on the detected presence of a designator signal at a designator spot on the target. The laser appointer signal is directed to the designator spot and detected by the munition laser rangefinder receiver. In one embodiment, the repeater system for detecting the designator signal and for generating the appointer signal is provided on the delivery vehicle for the submunition. This additional mode of operation is preferably achieved using the existing laser receiver of the rangefinder hardware, with minimal additional hardware and software systems for detecting and processing the additional laser appointer signal energy. In this manner, collateral damage and false-target firings are decreased to near-zero probability, without the need for deploying new laser designator systems.

In another aspect, the present invention is directed to a system for engaging a munition with a target The system comprises an autonomous munition, including: a rangefinder comprising: a laser transmitter that transmits a first laser energy to a remote target; a laser receiver that receives a reflected portion of the first laser energy as reflected by the remote target within a scanned field of view of the laser receiver and that receives a reflected portion of a second laser energy as reflected by the remote target within the scanned field of view of the laser receiver; and a range module that determines a range of the remote target from the reflected portion of the first laser energy. An illumination module determines whether the reflected portion of the second laser energy is present within the scanned field of view of the laser receiver. A laser designator generates third laser energy. A laser repeater receives the third laser energy as reflected by the remote target, and, in response, transmits the second laser energy to the remote target.

In one embodiment, the first laser energy and the second laser energy are of wavelengths that are substantially the same so that the laser receiver of the rangefinder can receive both the first laser energy and the second laser energy. In another embodiment, the third laser energy is of a wavelength that is different than that of the first laser energy and the second laser energy.

In another embodiment, the first laser energy is pulsed and wherein the second laser energy is modulated.

In another embodiment, the laser repeater is located at an airborne delivery vehicle that delivers the autonomous munition.

In another embodiment, the third laser energy is incident at the remote target and illuminates a third laser energy spot on the remote target, and wherein the second laser energy is incident at the remote target and illuminates a second laser energy spot on the remote target. In another embodiment, the second laser energy spot and the third laser energy spot overlap.

In another embodiment, the laser transmitter and laser receiver comprise a rangefinder for determining the range of the munition with respect to the target.

In another embodiment, the illumination module comprises a filter circuit that passes energy within an expected frequency band of the second laser energy.

In another embodiment, the second laser energy is modulated and wherein the illumination module includes a circuit that discriminates the second laser energy to determine whether the modulation in the second laser energy is present.

In another embodiment, the second laser energy is sourced from a ground location. In another embodiment, the scanned field of view of the laser receiver translates in an inward-spiral scan pattern during operation of the munition. The inward-spiral scan pattern has an inter-scan spacing between adjacent spiral scan segments. The second laser energy is incident at the remote target and illuminates a spot of a width that is larger than the inter-scan spacing.

In another embodiment, the munition further includes a warhead that is activated in response to whether the reflected portion of the second laser energy is present within the scanned field of view of the laser receiver.

In another embodiment, the munition further includes a passive infrared receiver that receives infrared energy emitted by the remote target within a scanned field of view of the infrared receiver.

In another aspect, the present invention is directed to a method for engaging a munition with a target comprising: transmitting first laser energy within a transmission field of view; receiving a reflected signal including a reflected portion of the first laser energy as reflected by a remote target within a receiver field of view; illuminating the remote target with a third laser energy; detecting the illumination of the remote target by the third laser energy and illuminating the remote target with a second laser energy; and determining whether the reflected signal further includes a reflected portion of the second laser energy as reflected by the remote target within the receiver field of view.

In one embodiment, the first laser energy and the second laser energy are of wavelengths that are substantially the same.

In another embodiment, the third laser energy is of a wavelength that is different than that of the first laser energy and the second laser energy.

In another embodiment, detecting the illumination of the remote target occurs at an airborne delivery vehicle that delivers the munition at which the transmission of the first laser energy and the reception of the first and second laser energy occur.

In another embodiment, the third laser energy is incident at the remote target and illuminates a third laser energy spot on the remote target, and wherein the second laser energy is incident at the remote target and illuminates a second laser energy spot on the remote target. In another embodiment, the second laser energy spot and the third laser energy spot overlap.

In another embodiment, the target is engaged as a result of the step of determining that the second laser energy is within the receiver field of view. In another embodiment, engaging the target comprises engaging the target when it is determined that the reflected signal includes the second laser energy. In another embodiment, engaging the target comprises engaging the target with a warhead.

In another embodiment, the method further comprises modulating the second laser energy for illuminating the remote target. In another embodiment, determining comprises discriminating the second laser energy using a bandpass filter that is centered at a frequency equal to that of a modulation frequency of the second laser energy. In another embodiment, the method further comprises amplitude-modulating, phase-modulating, or frequency-modulating the second laser energy.

In another embodiment, the receiver field of view translates in an inward-spiral scan pattern during operation of the munition. The inward-spiral scan pattern has an inter-scan spacing between adjacent spiral scan segments. In this case, illuminating comprises illuminating the remote target with the second laser energy of a spot size of a width that is larger than the inter-scan spacing.

In another embodiment, the method further comprises receiving an infrared signal at a passive infrared receiver including infrared energy emitted by the remote target within a scanned field of view of the infrared receiver.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
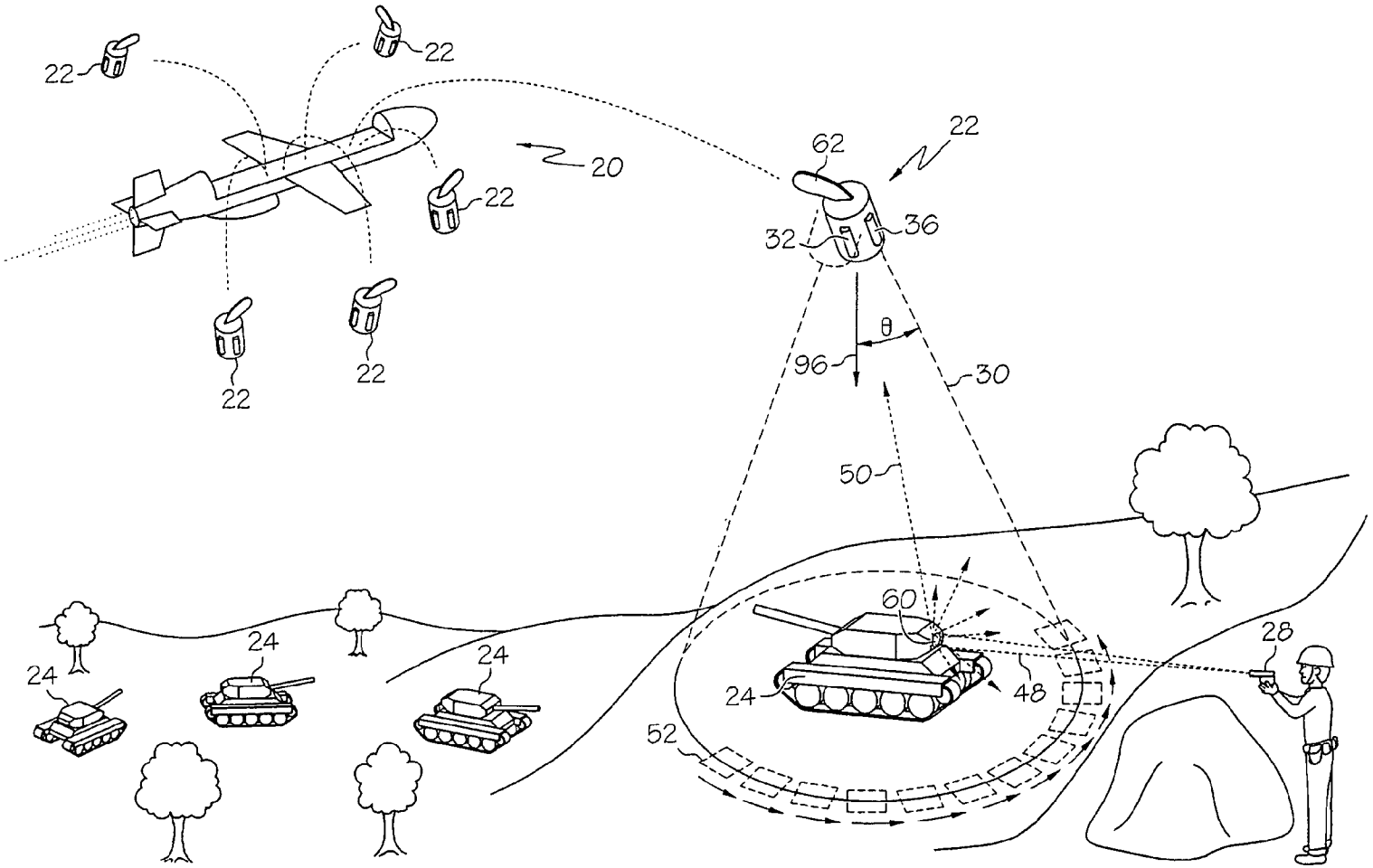
FIG. 1 is an exemplary illustration of operation of a first embodiment of the systems and methods of the present invention.
Figure 2:
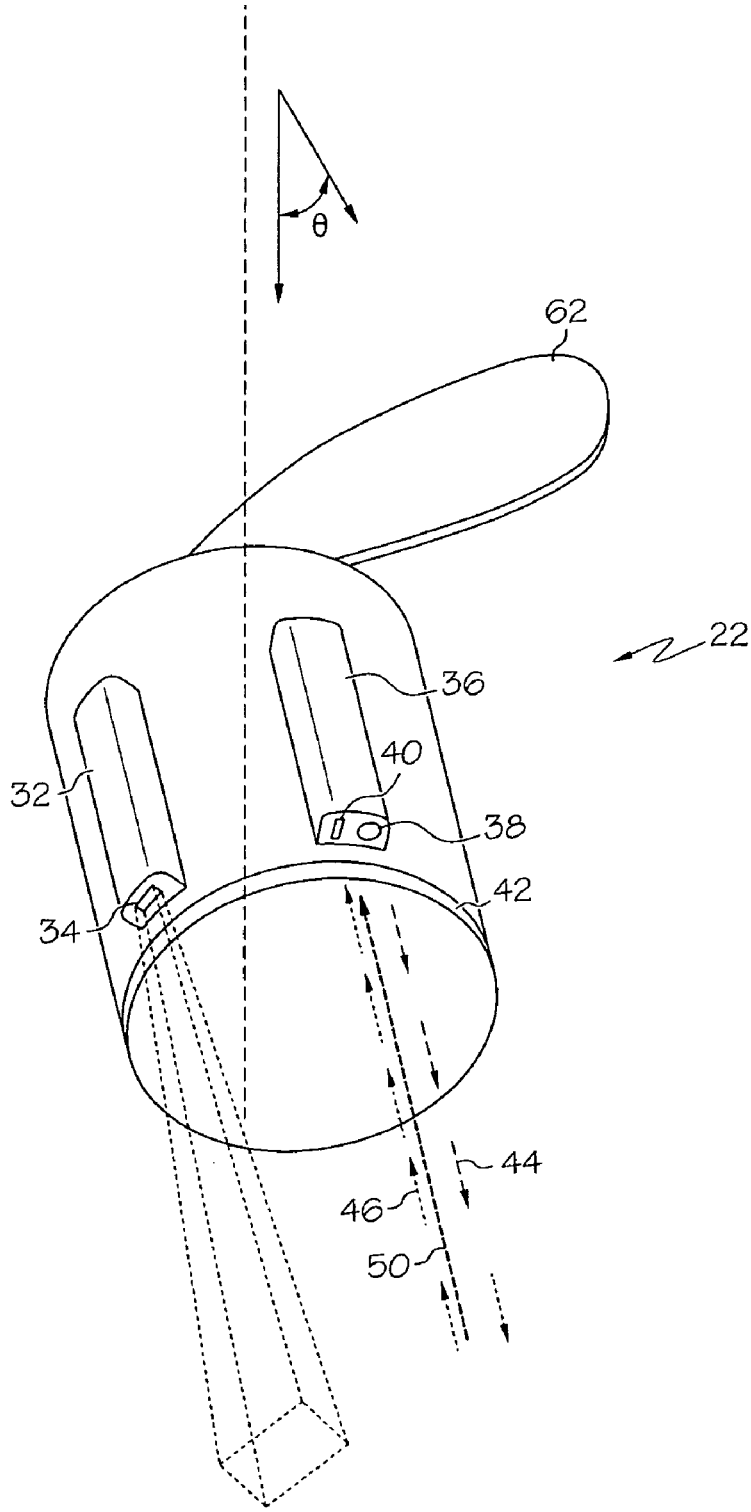
FIG. 2 is a close-up view of a munition in flight, in accordance with the first embodiment of the present invention.

FIG. 1 is an exemplary illustration of operation of the systems and methods of the present invention. FIG. 2 is a close-up view of a munition in flight during the operation illustrated in FIG. 1, in accordance with the present invention. Referring to FIG. 1, a plurality of submunitions 22 are dispensed and given independent and autonomous flight from a delivery vehicle 20 over a battlefield known to include enemy targets 24. The submunitions 22 are extracted from the delivery vehicle, for example, according to the techniques disclosed in U.S. Pat. No. 6,666,145, incorporated herein by reference above. The submunitions 22 are scattered across the battlefield as shown. Upon extraction, deceleration and stabilizer mechanisms 62 on each submunition 22 are activated to control the trajectory and velocity of the submunition 22, and to induce a spin of the submunition body about a trajectory axis 96 at a constant offset angle θ.

The submunitions 22 each include an infrared scanner 32. In one embodiment, the infrared scanner 32 comprises a dual-mode passive infrared scanner unit consisting of a set of optics that image the approximately 40 milliradian by 40 milliradian field of view onto a detector array in the focal plane. The target detector element is sensitive to infra-red energy emitted from the target at approximately 3 to 5 microns wavelength and is surrounded by a four segment guard band detector that is sensitive to infra-red emissions between 1 and 2 microns. The timing of the initiation and duration of signals received in these two channels as well as the ratio of their signal levels are used to discriminate between targets and false targets such as fires and hot fragments in the field of view. The infrared scanner 32 includes an infrared sensor element 34 (see FIG. 2) that converts infrared energy to electrical energy which is digitized and provided as a stream of data to a resident processor or processors located within the submunition 22 housing. Algorithms running on the processor perform target detection and classification operations and reach engagement decisions based on target presence within the scanned region, according to known techniques, in response to the received and collected infrared signatures.

The submunitions 22 each further include a laser rangefinder 36. In one embodiment, the laser rangefinder 36 comprises separate laser transmitter and laser receiver optical trains. The laser rangefinder 36 includes a laser rangefinder transmitter 38 (see FIG. 2) that emits a pulsed transmitted rangefinder beam 44 in the direction of the field of view of the passive infrared sensor 32 consisting of a pulse generator driving a laser diode at the focal plane of the transmit aperture lens that images the diode onto a spot that is 2 milliradians by 10 milliradians in the far field and a laser rangefinder receiver 40 that receives the reflected rangefinder beam 46, as reflected by the target, ground, or nearby structures and is collected via a larger laser receiver aperture lens that focuses the received laser pulse onto an avalanche photodiode detector mounted on the receive focal plane and a suitable time counting circuit that measures the elapsed time from pulse generation to pulse detection. The received laser energy is converted to data that is analyzed by the on-board processors to determine the slant range of the submunition 22 with respect to ground-based objects under scan by the passive infrared scanner 32, based on the time-of-flight of the transmitted and received rangefinder beam pulse 44, 46. The progression of the set of scanned pulses along the ground and then up onto and over the target provides a height profile of the target that can be further employed by the processors in conjunction with the infrared signatures to enhance accuracy in target detection and classification.

Upgrading the capability of the conventional sensor-fuzed munition to include both the conventional passive infrared sensor system and the recently added laser rangefinder system has improved the system target detection rate. However, while false-target detection rate and collateral damage rate are indeed improved by the addition of the laser rangefinder, even further improvement is provided by the systems and methods of the present invention, as will now be described in detail.

Referring to FIGS. 1 and 2, the systems and methods of the present invention improve on the conventional sensor-fuzed munition capability by taking advantage of additional, dormant, bandwidth capabilities of the existing laser rangefinder receiver 40 (see FIG. 2) to add an additional mode of operation referenced to herein as "laser-designator mode". To accomplish this, an additional beam of energy, referred to herein as "designator beam" 48, is used to illuminate the target 24 with electromagnetic energy, for example energy at a laser wavelength. The laser designator beam 48 is generated by a laser designator transmitter 28 and is directed by ground-based personnel, or alternatively, may be directed by air-based personnel, or ground-based, air-based, or space-based automated systems. The transmitted designator beam 48 is incident on the target at designator spot 60. The beam is reflected by the target 24 at spot 60 and a portion of the reflected designator beam 50 is oriented toward the scanning submunition 22, and received by the laser rangefinder receiver 40 (see FIG. 2). In one embodiment, the reflected designator beam 50 is received by the same laser rangefinder receiver 40 as the reflected rangefinder beam 46. Alternatively, a separate laser energy receiver that is independent of the laser range finder receiver 40 may be used to receive the reflected designator beam 50.

The laser energy received at the laser rangefinder receiver 40 is processed and analyzed to determine the presence of the reflected designator beam 50 at the target. The presence or absence of the reflected designator beam 50 energy in the received energy is then used to reach a determination as to whether to fuze the warhead of the munition. In this manner, the dispensing platform, or other suitable platform, has detected and selected the intended target for engagement by the munition and this platform is and can remain in position to provide continuous direct line-of-sight contact with the intended target during the time of flight of the munition to the target. This situation has already been successfully exploited for a class of precision-guided weapons referred to as laser-guided or laser-designated munitions. In the previously deployed laser-guided or laser-designated weapons, a seeker, usually a gimbaled seeker, in the nose of the munition, searches for the laser-illuminated-and-coded spot on the ground or target, and once found, locks on to that laser reflected signal to guide the munition to strike the target. A similar principle is applied in the present invention; however, the present invention must accommodate the inward-spiral scan pattern of the sensor-fuzed munition. Typical scan rates for the inward spiral scan are in the range of 12,000 to 22,000 feet per second. With this inward-spiral scan pattern, the sensor-fuzed munition may scan over the laser-illuminated spot only a single time, for a very brief period of time. At 22,000 feet per second, the scan passes through a 1-foot spot in less than 50 microseconds. Based on that single, brief, detection, the system must recognize the laser designator and enable the sensor to detect and trigger on that target in the same time frame that the sensor fuzed scan operation normally allows, for example on the order of about 50 microseconds. By recognizing the reflected designator beam, and by integrating this additional information with the information received by the conventional sensor-fuzed operation, the munition can be optionally programmed to engage only the selected, laser-designated, target, and no other, thus satisfying the need for reduced collateral damage and avoiding engagement with unintended targets in complex environments.

A designator beam 48 having a spot configuration 60 incident at the target 24 that will be detected and recognized by the laser rangefinder receiver of the sensor-fuzed munition is critical. The designator spot 60 must be provided in a manner and time coincidence such that that its presence can be used to enable the munition to lethally engage the target 24 so designated. The laser rangefinder 36 is configured to detect and recognize the designator spot 60 and decision logic is incorporated into the sensor processor system that enables the munition 22 to appropriately respond to the designator spot 60. Existing detection processes can optionally be modified to engage only the designated target when laser-designator mode is selected, and, for example, to revert to the conventional mode of operation to autonomously detect and engage targets when the laser-designator mode is not selected. Existing laser receivers of the rangefinder systems are designed to detect the short, high-intensity laser pulses that are generated by the resident laser rangefinder transmitter and to measure the time-of-flight of the pulses in order to estimate the instantaneous slant range to the ground or target while the submunition is scanning an arc of the region of interest at a rotational velocity of roughly 60 to 90 radians per second. This rotational velocity is given by the sine of the offset angle between the sensor and the vertical times the number of scan cycles per second. In the typical cases, the rotation rate is 30 cycles per second times a 30 degree offset angle giving 94 radians per second. In another embodiment, the offset angle is 20 degrees yielding 64 radians per second. The instantaneous field of view of the laser rangefinder receiver is on the order of a foot, so that the dwell time on any laser designator beam spot is on the order of 50 microseconds. Hence, the convenience of a laser designator that is continuously seen and tracked within the laser receiver field of view, such as that enjoyed by conventional laser-guided systems, is not available to the present sensor-fuzed munition application.

Figure 3:
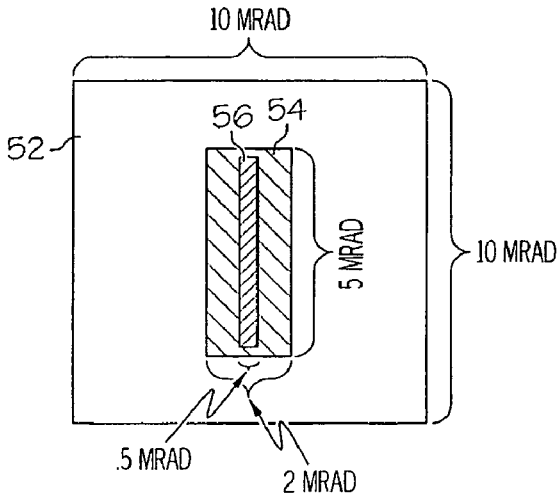
FIG. 3 is an exemplary illustration of the respective fields of view of the passive infrared sensor, the laser rangefinder receiver and the laser rangefinder transmitter of the munition of FIG. 2.

FIG. 3 is an exemplary illustration of the respective fields of view of the passive infrared sensor 34, the laser rangefinder receiver 40 and the laser rangefinder transmitter 38 of the munition 22 of FIG. 2. At any instant in time, the field of view of the passive infrared target detection sensor 52 is on the order of 10 milliradians by 10 milliradians, the field of view of the laser rangefinder receiver 54 is on the order of 5 milliradians by 2 milliradians, and the field of view of the laser rangefinder transmitter 56 is on the order of 5 milliradians by 0.5 milliradians. Assuming a standoff range of approximately 200 feet, the projected image of the passive infrared sensor 52 in the region of interest is on the order of 2 ft by 2 ft, the projected image of the laser rangefinder receiver 54 in the region of interest is on the order of 1 ft by 0.4 ft, and the projected image of the laser rangefinder transmitter 56 in the region of interest is on the order of 1 ft by 0.1 ft. Therefore, at any given instant in time, the region under scan by the laser rangefinder 36 is relatively narrow, relative to the region under scan by the passive infrared system 32.

Figure 4B:
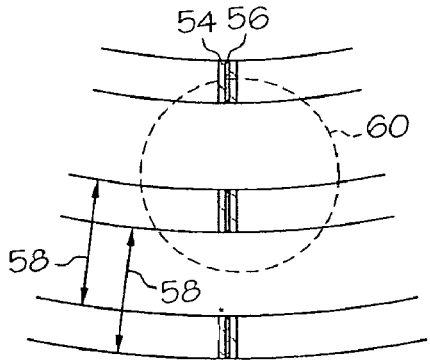
FIG. 4B is a close-up view of the scan pattern of FIG. 4A, illustrating the size of the transmitted designator beam at the target relative to the inter-scan spacing distance and relative to the field of view of the laser rangefinder receiver, in accordance with the present invention.
Figure 4A:
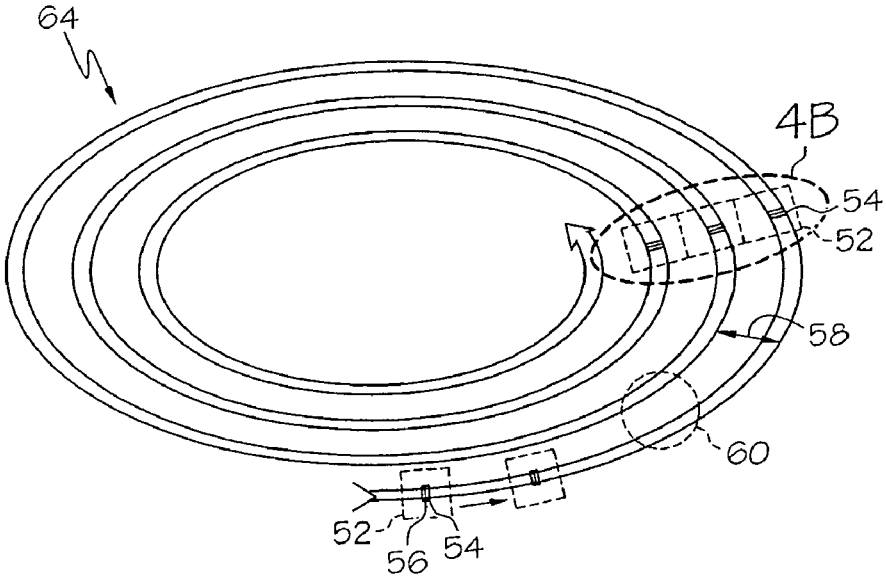
FIG. 4A is a conceptual illustration of the inward-spiral scan pattern of the munition of FIG. 2.

FIG. 4A is a conceptual illustration of the inward-spiral scan pattern of the munition of FIG. 2. FIG. 4B is a close-up view of the scan pattern of FIG. 4A, illustrating the size of the transmitted designator beam at the target relative to the interscan spacing distance and relative to the field of view of the laser rangefinder receiver, in accordance with the present invention. As described above, during flight of the munition, the munition is spinning about its vertical axis at an offset angle θ, as described above. At the same time, the munition is continuously losing altitude. Therefore, the projected images of the sensor infrared and laser receivers sweep the region of interest in an inward spiral pattern 64, as shown in FIG. 4A (also see the scan pattern of the projected image of the passive infrared sensor 52 in the region of interest in FIG. 2). At each complete revolution of the munition 22, the successive projected images of the laser rangefinder receiver at adjacent segments of the spiral may actually overlap, as shown; however, due to the relatively narrow profile of the projected image of the laser rangefinder receiver 54, subsequent sweeps at adjacent spiral segments are spaced apart from each other as shown. This phenomenon is referred to as "interscan spacing", and is represented by the distance 58 between adjacent spiral arc segments of the scans at each revolution.

Interscan spacing 58 of the laser rangefinder receiver field of view 54 is an important consideration in the present invention. For example, if the laser designator beam 48 illuminates a spot 60 on the target 24 that is small relative to the interscan spacing 58, the spot 60 may fall entirely between adjacent scan segments, and will not be detected by the scanning system. Therefore, in order to ensure that the laser rangefinder receiver 40 will detect the reflected designator beam 50 from the spot 60 of the laser designator beam, the beam spot 60 should be large enough to subtend the anticipated maximum interscan spacing 58. If the spot is also circular, its extent in the direction of scan also ensures an adequate dwell time of the field of view of the laser rangefinder receiver 54 within the designator beam spot 60, and therefore greatly reduces the possibility of missing the scanning and detecting of a properly applied laser designator beam. For the example given above, an illuminated designator spot 60 at the target of a size at least 1.5 m in width would be sufficient to secure detection at the laser rangefinder receiver of the reflected designator beam. It will be noted by those skilled in the art that spreading the same total amount of laser energy over a larger spot size will diminish its intensity and reduce the return signal level. Hence a tradeoff of spot size versus spot intensity must be made.

In defining the spot 60 characteristics of the laser designator transmitter 28 at the target such that the there is high assurance of the spot 60 being "seen", and instantly recognized, by the rangefinder laser receiver 40 and associated processor, the characteristics of the scanning rangefinder laser sensor and processor are to be considered. The laser rangefinder transmitter 38 generates a rangefinder beam 44 at a wavelength on the order of 900-940 nanometers (near-IR). Also, the laser receiver scan rate is on the order of 60 radians per second (or 60 milliradians per millisecond) and its slant range varies from 15 to 100 meters. The laser rangefinder transmitter sends out roughly 10 nanosecond-duration pulses roughly every 50 microseconds and the laser rangefinder receiver scans for laser pulse returns during the first 700 nanoseconds (or 0.7 microseconds) of each inter-pulse interval. That leaves the remaining 49.3 microseconds (98.6% of the time) for the laser rangefinder receiver system to detect and recognize the designator laser beam spot on the target. The relationship between the angular scan rate and the translational velocity, which translational velocity can range between horizontal and vertical orientations, results in an interscan spacing 58 of the projected image of the laser rangefinder receiver 54 of approximately 1 to 1.5 meters. That interscan spacing 58 and the size of the laser rangefinder receiver instantaneous field of view (0.15 to 1 meter) require that, for this example, the laser designator spot be at least 1.5 meters in cross-scan width to insure that the receiver field of view 54 passes through the designator spot 60 at least once during its scan search.

The spot 60 of the laser designator beam 48 is directed to the desired target 24 and, preferably, to the desired aim-point on that target, so as to ensure that the sensor-fuzed munition will detect and recognize the laser designator beam 48 in time to attack the target during that scan. At the shortest anticipated range of the submunition, for example at about 15 meters, the 10-milliradian field-of-view of the laser rangefinder receiver 54 scanning at a rotational velocity of 60 milliradians per second will "dwell" on the spot 60 for about 1.6 milliseconds. At the longest anticipated range of the submunition at about 100 meters, the laser rangefinder receiver field-of-view will dwell on the spot 60 for about 0.7 milliseconds. In view of this, the laser designator transmitter 28 should be configured to continuously illuminate the target 24 with the laser designator beam 48 of an appropriate size so that the spot 60 can be detected at the instant the laser rangefinder receiver field of view 54 scans over the spot 60.

In addition, it is preferred that the reflected energy of the laser designator beam 48 is distinguishable from the solar-illuminated background. This can be accomplished by amplitude-modulating the laser transmitter at a frequency in the range of about 50-100 kHz, in order to provide a sufficient number of cycles (>>10) to be detected and recognized by this laser designator receiver channel. The desired amplitude modulation may be accomplished by causing the voltage of the drive signal to the laser diode to be varied by a sinusoidal function whose frequency is between 50 and 100 kHz. In alternative embodiments, the laser designator beam 48 is phase-modulated or frequency-modulated in order to discern the designator beam from background noise. When this amplitude modulated continuous wave (AMCW) signal is detected at the laser rangefinder receiver in the avalanche photodiode detector, the detected signal is passed though several filters in parallel as shown below in FIG. 6. The AMCW laser designator reflected signal is passed through a band pass filter that is matched to the AMCW modulation rate of the laser designator (50 to 100 kHz). The pulsed laser rangefinder signal is passed through the 1 MHz to 40 MHz band pass filter that feeds the compute range module.

Figure 5:
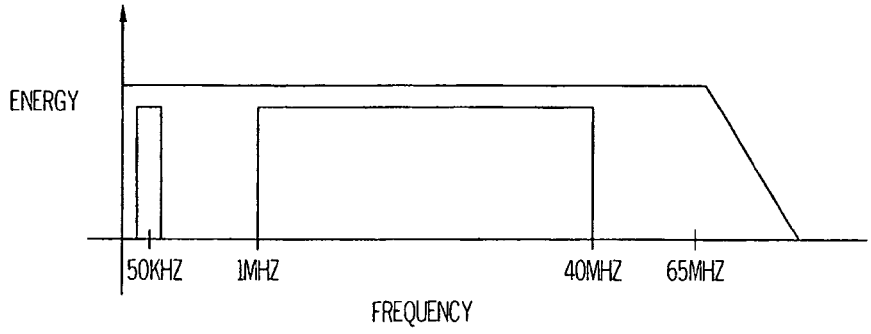
FIG. 5 is a graph of signal energy as a function of frequency at the laser rangefinder receiver, illustrating the electronic bandwidth of the transmitted and received laser rangefinder energy, in accordance with the present invention.

FIG. 5 is a graph of signal energy as a function of frequency at the laser rangefinder receiver, illustrating the electronic bandwidth of the transmitted and received laser rangefinder energy. The laser designator AMCW signal is centered around the 50 kHz while the energy of the laser rangefinder pulsed signals is within the 1 MHz to 40 MHz bandpass.

Figure 6:
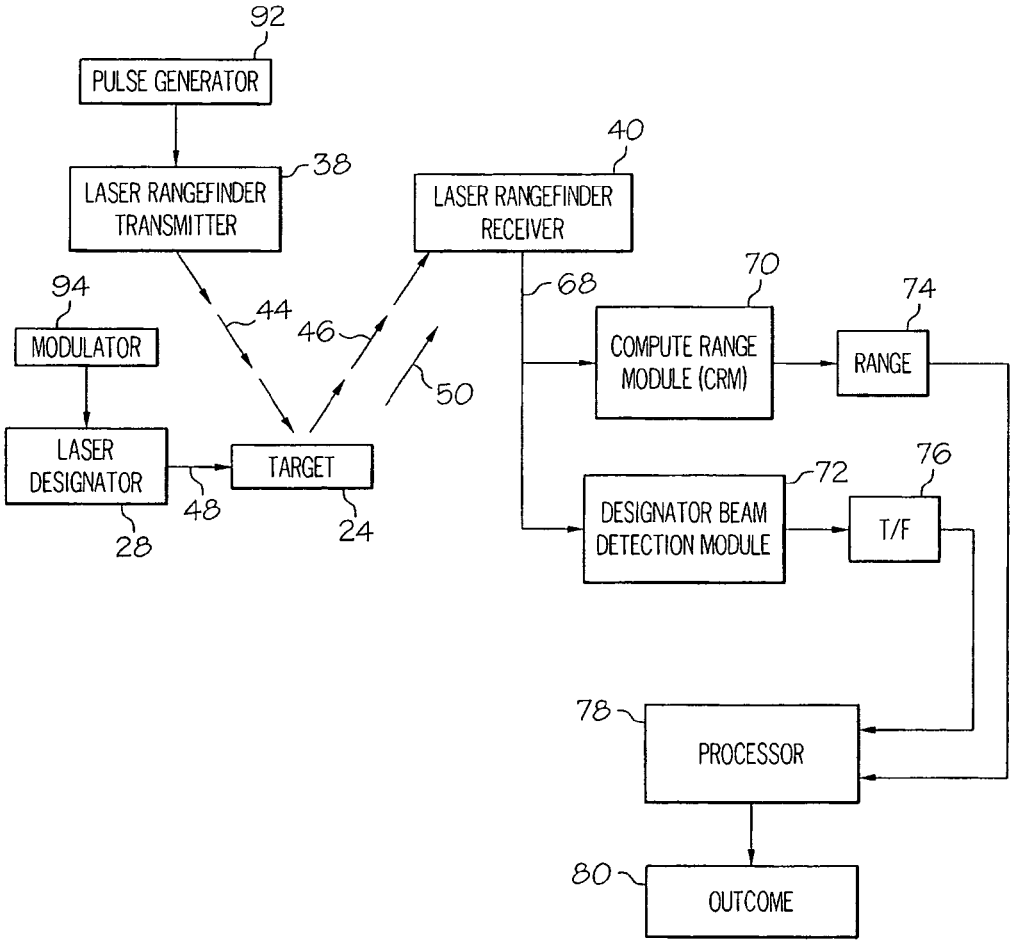
FIG. 6 is a system block diagram of the laser designator transmitter, the laser rangefinder transmitter, the laser rangefinder receiver, and related processor in accordance with the present invention.

FIG. 6 is a system block diagram of the laser designator transmitter, the laser rangefinder transmitter, the laser rangefinder receiver, and the related processor in accordance with the present invention. In FIG. 6, a laser designator 28, which is situated on a separate platform from the munition, generates a continuous designator laser beam 48. The beam 48 is modulated by modulator 94, which, in one embodiment, provides amplitude modulation of the beam, as described above, and is directed at the target 24 to generate a beam spot 60 at the target 24. At the same time, the laser rangefinder transmitter 38 of the sensor-fuzed munition generates a rangefinder beam 44 that is scanning the region of interest below the munition during its flight. The rangefinder beam 44 is pulsed by pulse generator 92 so that time-of-flight of the pulse can be measured for the purpose of range determination. The reflected rangefinder beam 46 is sensed by the laser rangefinder receiver and processed. A portion of the reflected energy of the designator laser beam 50 is also received by the laser rangefinder receiver 40. The two received laser signals are nominally at the same optical wavelength (about 900 to 940 nanometers in this embodiment) and hence are passed through the same receive optics and detected in the same avalanche photodiode detector and converted to electrical signals. These two sets of electrical signals are each presented to two parallel bandpass filters which each pass one signal and not the other. The 50 kHz bandpass filter located in the designator beam detection module 72 passes the designator laser signal 50 component of received signal 68 to the true/false ("T/F") processor 76 and rejects the reflected rangefinder beam component 46, while the 1 MHz to 40 MHz bandpass filter located in the compute range module 70 rejects the designator laser signal component 50 and passes the reflected rangefinder beam component 46 along to the compute range module 70.

A compute range module (CRM) 70 processes the received signal 68, and computes the range 74 of the munition relative to the target, or relative to the ground surrounding the target, depending on the positioning of the field-of-view of the laser transmitter 38 and receiver 40 relative to the target 24. The determination of range 74 by the CRM is based on the time-of-flight (each additional 2 nanoseconds of elapsed time equals 1 foot of range) of the transmitted, reflected, and received rangefinder laser signal pulse 44, 46, and is computed according to conventional techniques.

A designator beam detection module 72 that uses standard constant false alarm rate techniques also processes the received signal 68, and determines whether a reflected designator beam 50 is present in the energy received at the laser rangefinder receiver 40. In one embodiment, the determination results in a true (laser designator beam is present) or false (laser designator beam is not present) reading 76.

The range information 74 and the true/false reading 76 are provided to the system processor 78 which generates an outcome 80 based on the information provided. In one embodiment, when operating in laser designator mode, a true reading 76 by the designator beam detection module 72 is required before the warhead can be fired. In another embodiment, when operating in laser designator mode, a true reading 76 by the designator beam detection module 72 results in a firing of the warhead, irrespective of the readings by the other sensor or sensors. In another embodiment, when operating in laser designator mode, a true reading 76 by the designator beam detection module 72 results in the firing of the warhead only if readings by the other sensor or sensors confirm that such a firing should take place. In another embodiment, a false reading 76 by the designator beam detection module 72 results in deactivation of the firing of the warhead, irrespective of the readings by the other sensor or sensors. In another embodiment, a false reading 76 by the designator beam detection module 72 is taken into consideration by the processors, but a firing of the warhead can still occur if readings by the other sensor or sensors confirm that such a firing should take place. The processor 78 can be programmed to initiate any of a number of possible outcomes 80, including and beyond those exemplary embodiments mentioned above, in view of the detection or non-detection of the presence of the laser designator beam on the anticipated target. The determination of the presence, or not, of the laser designator beam on the target can be combined with the results of other sensors, including whether certain criteria concerning the target are met by the data collected by the passive infrared sensors on the munition, and whether certain criteria are met by the data collected by the active rangefinder 40 of the munition. Any logic combination can be conceived regarding these, and other, criteria in formulating a decision regarding engagement by the munition.

In another mode of operation, the laser designator can be directed by the host platform to the preferred engagement location of the target, and, when engagement occurs, the munition can be fired at the designator spot on the target.

Figure 7A:
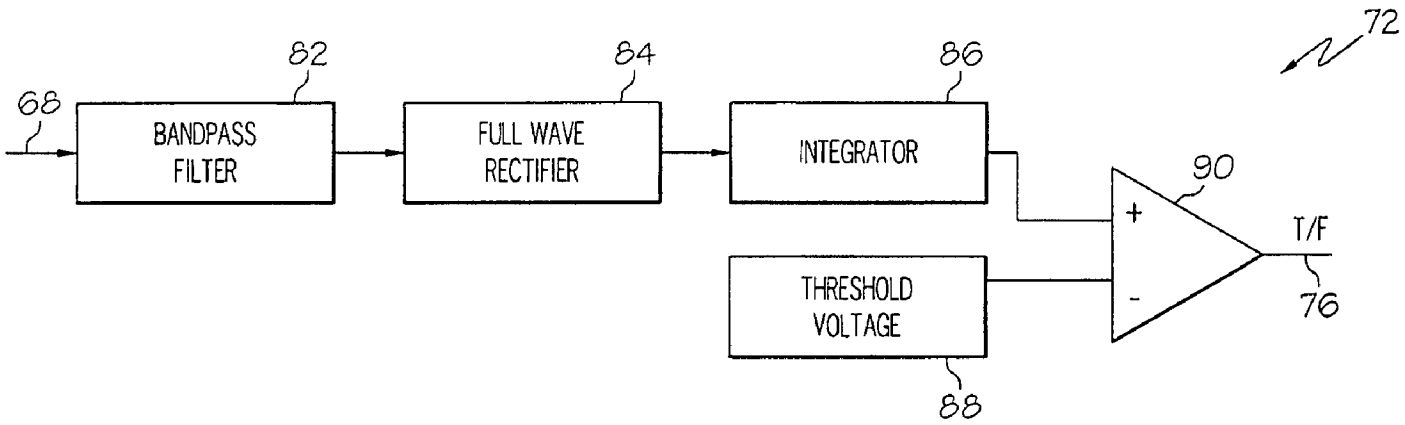
FIG. 7A is a block diagram of an embodiment of the designator beam detection module, in accordance with the present invention.

FIG. 7A is a block diagram of an embodiment of the designator beam detection module 72, in accordance with the present invention. A bandpass filter 82 receives the signal 68 generated by the laser rangefinder receiver 40 (see FIG. 6). The bandpass filter 82 is configured to pass a narrow band of received energy around the modulation frequency of the laser designator beam 48, as modulated by the modulator 94. The resulting amplitude-modulated signal, if present, is provided to the full-wave rectifier 84 that performs an absolute-value function on the signal. The rectified signal is integrated at integrator 86, which integrates for the period of time that the laser rangefinder receiver dwells in the illuminated spot of the target provided by the designator beam. The resulting DC signal is compared to a threshold voltage at comparator 90. The output of the comparator 90 is the true/false reading 76.

Figure 7B:
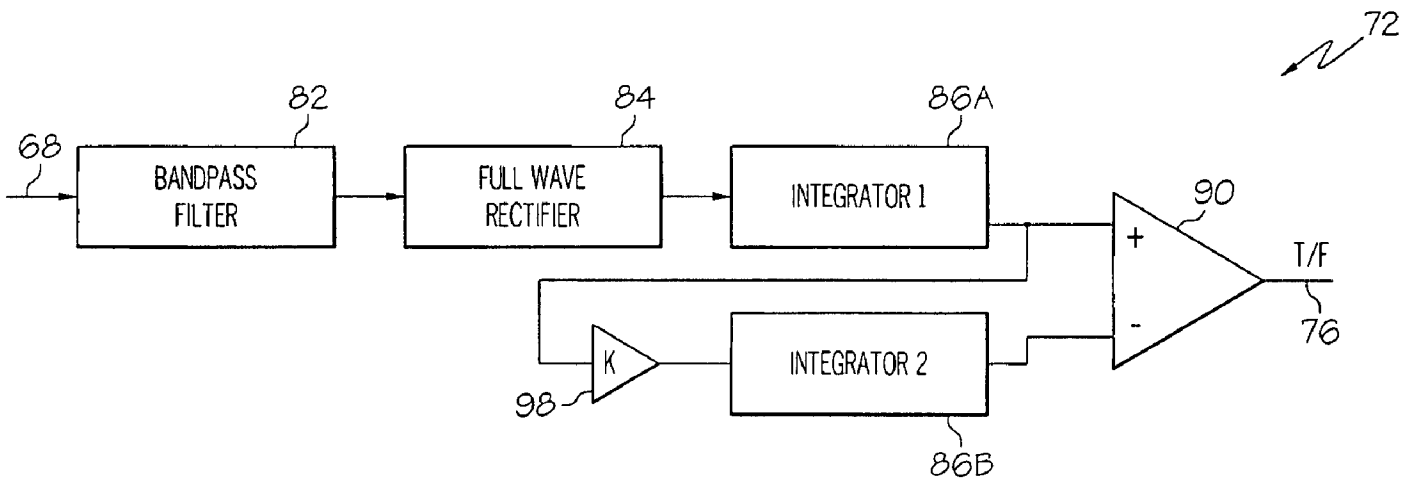
FIG. 7B is a block diagram of an alternative embodiment of the designator beam detection module, in accordance with the present invention.

FIG. 7B is a block diagram of an alternative embodiment of the designator beam detection module 72, in accordance with the present invention. As in the embodiment of FIG. 7A, the input signal 68 is bandpass filtered at filter 82, rectified at rectifier 84 and integrated at the first integrator 86A. The integration period of the first integrator 86A is equal to the dwell time of the laser signal 56 in the field of view of the receiver 54. The output of the first integrator 86A is applied to a positive terminal of comparator 90. A constant false alarm rate (CFAR) threshold is achieved by further applying the output of the first integrator 86A to an amplifier 98, having a gain of K, and then integrating the amplified output for a much longer time period at the second integrator 86B. In one embodiment, the integration period for the second integrator 86B is approximately the time elapsed during one circular scan of the system, in other words, the time for the inter-scan spacing 58. The output of the second integrator 86B is applied to a negative terminal of the comparator 90. The output of the comparator 90 is the true/false reading 76. The false alarm rate in this embodiment is therefore controlled by the gain K of the amplifier 98.

Other systems and methods for determining the presence of reflected designator beam energy 50 in the signal received by the laser rangefinder receiver 40 are equally applicable to the present invention, including systems that detect phase-modulation or frequency-modulation in the laser designator beam, for those systems incorporating such modulation.

The addition of a laser designator mode capability to the sensor-fuzed munition provides the greatest flexibility with regard to the Rules of Engagement in effect at the time of its use. The sensor-fuzed munition can optionally operate in the standard mode that employs infrared target detection and laser rangefinding capabilities, without the need for external designation by a designator beam, or, alternatively, to require laser designation when it is available and appropriate. In this manner, a desired level of fire control can be achieved and avoidance of unintended or collateral damage can be further realized.

In other embodiments of the present invention, the munitions or submunitions can be dispensed from different types of delivery vehicles, for example by the missile-based system illustrated above in conjunction with FIG. 1, or alternatively, from manned aircraft, unmanned aircraft (UAVs), or ground-based launch systems. Cluster bomb units (CBUs) which release a plurality of sub-modules that are each decelerated by parachute, for example BLU-108 sub-modules, each sub-module containing a plurality of submunition projectiles, may also be deployed. The designator beam for illuminating the target can optionally be provided from a ground-based location, as shown, or, alternatively may be provided by other ground-based, air-based, or space-based locations. The designator beam may be manually directed at the target as shown in FIG. 1, or, alternatively, may be automatically directed using automated systems.

In another embodiment, multiple laser designator beams 48 at multiple wavelengths, from one, or multiple platforms can be used to relay information about the target to the laser rangefinder receiver 40 on the munition 22. In this case, the different designator beams can be distinguished using different modulation frequencies that are resolved at multiple band pass filters in the designator beam detection module 72. The ability to differentiate between the multiple designator beams is determined by the dwell time of the receiver beam on the reflected source, or the number of cycles of modulation that are received in the band pass filter.

Figure 8A:
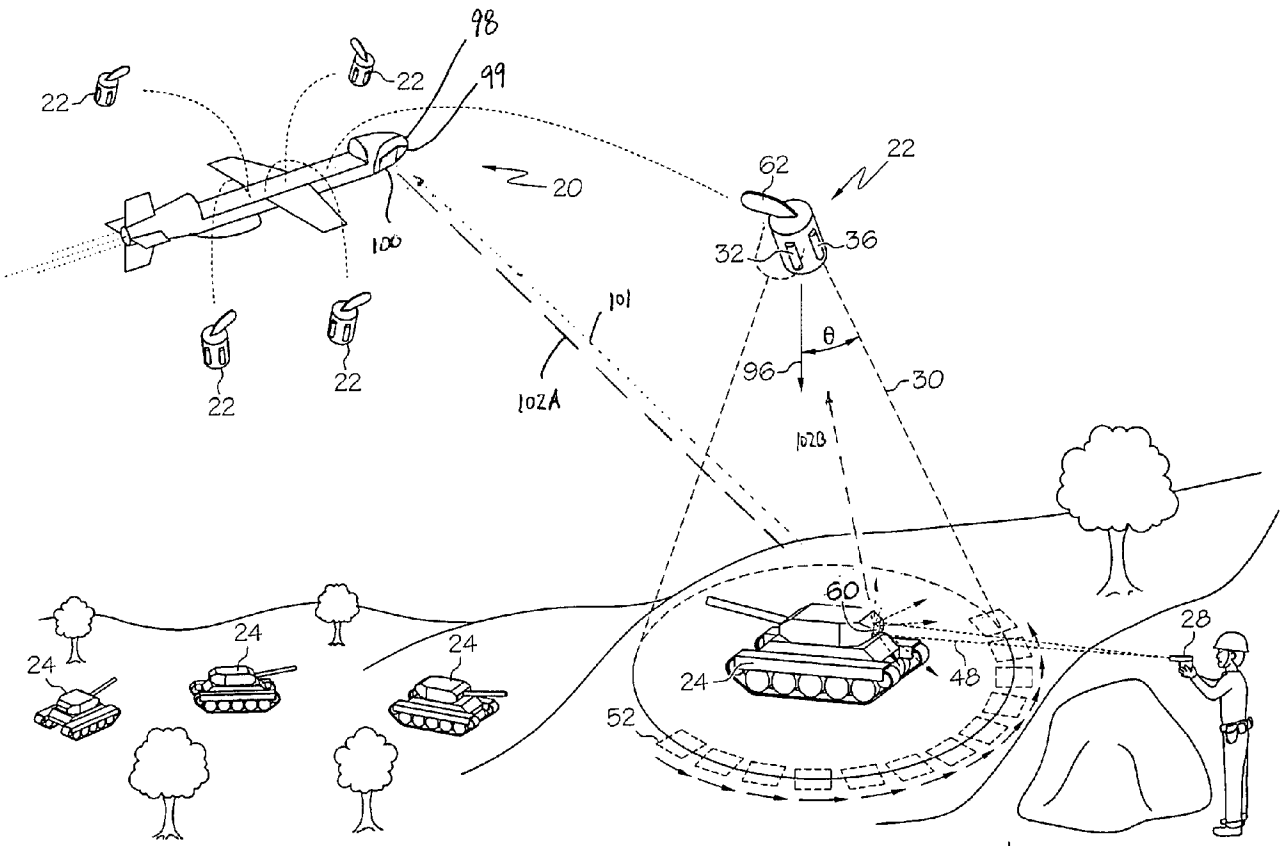
FIG. 8A is an exemplary illustration of operation of a second embodiment of the systems and methods of the present invention.
Figure 8B:
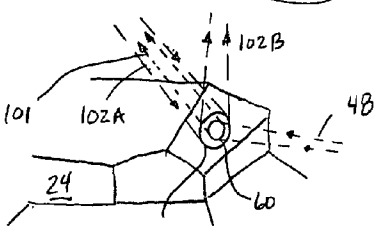
FIG. 8B is a close-up illustration of the designator beam and appointer beam illumination spots incident on the target, in accordance with the present invention.
Figure 9:
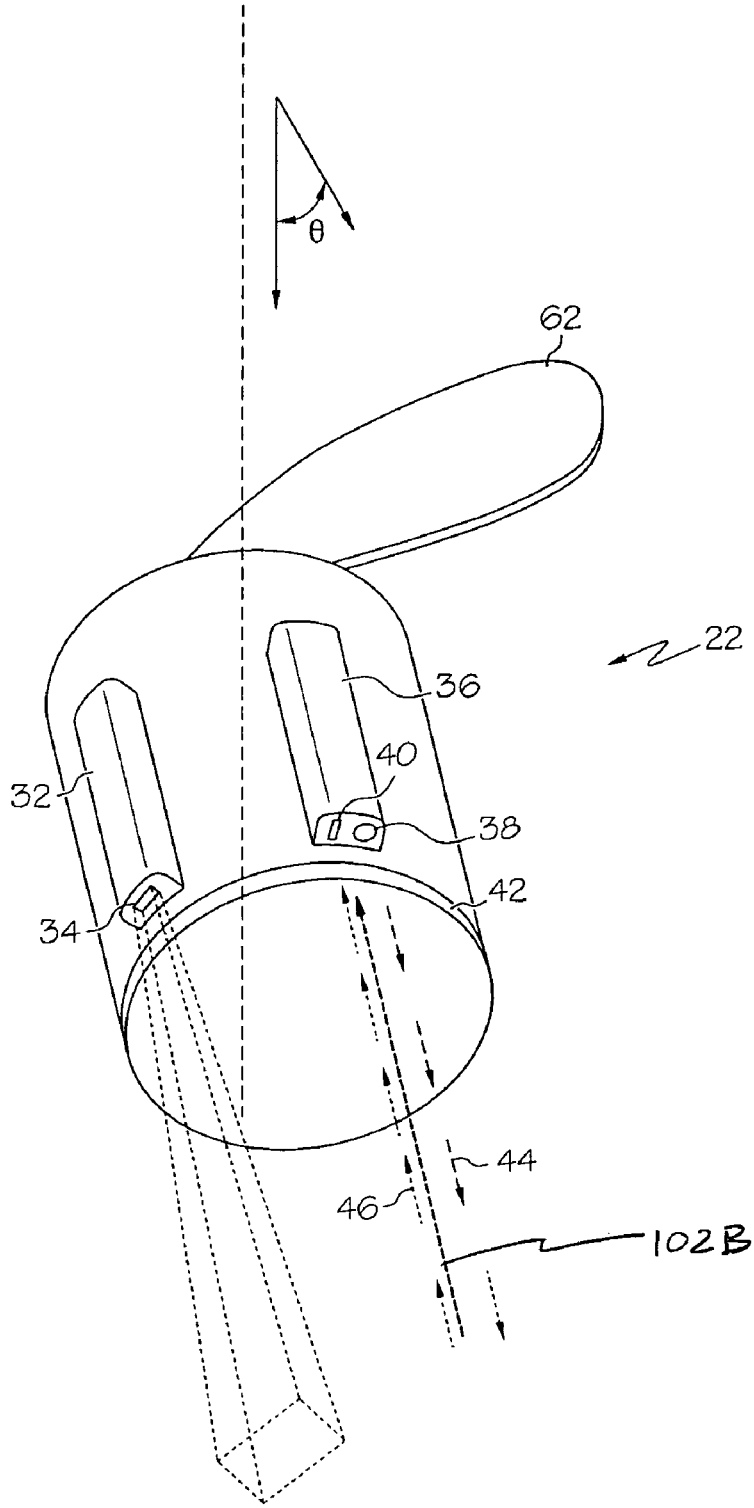
FIG. 9 is a close-up view of a munition in flight, in accordance with the second embodiment of the present invention.

FIG. 8A is an exemplary illustration of the operation of a second embodiment of the systems and methods of the present invention. FIG. 8B is a close-up illustration of the designator beam and appointer beam illumination spots incident on the target, in accordance with the present invention. FIG. 9 is a close-up view of a munition in flight, in accordance with the second embodiment of the present invention.

In many applications, the characteristics of the laser designator transmitter 28 operating in the field, for example the wavelength of the emitted designator beam as emitted for example by a standard STANAG laser designator, can be inconsistent with the characteristics of the laser rangefinder 36 of the submunition 22, for example, the wavelength of the laser rangefinder beam and the wavelength to which the laser rangefinder detector is tuned. The delivery vehicle 20, however, is designed for use with certain types of submunitions 22, and therefore is knowledgeable of the type of submunitions 22 it contains, and therefore the characteristics of the laser rangefinder 36 of the submunitions 22.

In this embodiment, the delivery vehicle 20 is equipped with a laser repeater system 98 including a laser receiver 99 and laser transmitter 100 that can detect the illumination of the target by the standard laser designator transmitter 28. When the laser receiver 99 of the laser repeater system 98 of the delivery vehicle 20 detects the presence of laser designator illumination on the target 24, as reflected from the target at the designator illumination spot 60, the laser transmitter 100 of the laser repeater system 98 of the delivery vehicle 20 transmits a beam of electromagnetic energy, for example a laser beam, referred to herein as an "appointer beam" 102A to the designator illumination spot 60 at the target. The laser transmitter 100 of the laser repeater system 98 therefore provides a secondary illumination spot 160 at the target, referred to herein as an "appointer spot", that is superimposed on the designator spot 60. The appointer beam 102A has characteristics, for example is at a wavelength, that are known to be consistent with the characteristics of the laser rangefinders 36 of the submunitions 22 released from the delivery vehicle 20. The reflected energy 102B of the appointer spot 160 can therefore be readily detected and processed by the laser rangefinder 36 of the submunition 22, for example, the rangefinder laser signal and the reflected appointer laser signal can be received by the same laser receiver and processed in different channels of the same laser receiver.

In this embodiment, the transmitter 100 of the appointer beam 102A operates as a slave to the designator beam 48 of the standard laser designator 28. In this manner, the laser rangefinder 36 of the submunition 22 is made to be compatible with the existing laser designators 28 that are deployed in large numbers in the field, and therefore would be costly to replace.

With reference to FIG. 8A and the inset, close-up diagram of FIG. 8B, the designator beam 48 is used to illuminate the target 24 with electromagnetic energy, for example, laser energy, as described above. This energy is referred to as the laser designator beam 48, as described above. The transmitted designator beam 48 is incident on the target at designator spot 60. The beam is reflected by the target 24 at designator spot 60 and a portion of the reflected designator beam 101 is oriented toward the delivery vehicle 20. In this embodiment, the delivery vehicle 20 is equipped with a laser repeater system 98 that includes a laser receiver 99 and a laser transmitter 100. The laser receiver 99 of the laser repeater system 98 receives and detects the reflected designator beam 101, and in response, the transmitter 99 of the laser repeater system 98 is made to transmit a laser appointer beam 102A that is oriented toward the original designator spot 60.

The laser repeater system 98 can have a number of different configurations that include the functions of detecting the laser designation illumination spot 60 on the target 24, centering its laser receiver 99 optics instantaneous field of view on the centroid of that illumination spot 60 and directing a second laser appointer illumination in the form of laser appointer beam 102A so as to be nominally superimposed on the first laser designator illumination spot 60. In one embodiment, the repeater system 98 can utilize standard NATO STANAG laser designator receiver hardware (optics, processors and gimbals) for detection of the laser designator spot 60, such as hardware found in any of several semi-active laser precision guided munitions seeker front ends. These include hardware found in the entire class of PAVEWAY munitions that can be used to search for, detect, and centroid on the standard laser designator illumination spot 60. In the process of adjusting the instantaneous field of view so as to be aimed at the illumination spot 60, the repeater system 98 simultaneously aims its laser transmitter 100 at the same location so that the resulting laser appointer beam 102A is superimposed on the laser designator spot 60. This can be accomplished by mounting the laser appointer transmitter 100 on the laser receiver 99 gimbals so as to be axially or par axially aligned.

The laser appointer beam 102A is incident on the target 24 at a secondary illumination spot 160, referred to herein as an "appointer spot" 160, that is superimposed on the designator spot 60. Although the appointer spot 160 is shown as being larger in area than the designator spot 60, the appointer spot 160 can have the same area, or can be smaller in area than the designator spot 60. In addition, although the appointer spot 160 is shown as completely overlapping the designator spot 60, the appointer spot 160 can partially overlap with, or not overlap, the designator spot 60.

A portion of the reflected laser appointer beam 102B, as reflected by the target 24 as appointer spot 160, is detected and received by the laser rangefinder receiver 40 (see FIG. 2) of the submunition 22. In one embodiment, the reflected laser appointer beam 102B is received by the same laser rangefinder receiver 40 as the reflected rangefinder beam 46. Alternatively, a separate laser energy receiver that is independent of the laser range finder receiver 40 may be used to receive the reflected appointer beam 102B.

The laser energy received at the laser rangefinder receiver 40 is processed and analyzed to determine the presence of the reflected laser appointer beam 102B at the target. The presence or absence of the reflected laser appointer beam 102B energy in the received energy is then used to reach a determination as to whether to fuse the warhead of the munition. In this manner, the dispensing platform, or other suitable platform, has detected and selected the intended target for engagement by the munition and this platform is, and can remain, in position to provide continuous direct line-of-sight contact with the intended target during the time of flight of the munition to the target, as described above.

A laser appointer beam 102A having a spot configuration 160 incident at the target 24 that will be detected and recognized by the laser rangefinder receiver 40 of the sensor-fuzed munition is critical. The designator spot 160 is optimally provided in a manner and time coincidence such that that its presence can be used to enable the munition to lethally engage the target 24 so designated. The laser rangefinder 36 is configured to detect and recognize the designator spot 160 and decision logic is incorporated into the sensor processor system that enables the munition 22 to appropriately respond to the designator spot 160. Existing detection processes can optionally be modified to engage only the designated target when such a laser-designator-repeater mode is selected, and, for example, to revert to the conventional mode of operation to autonomously detect and engage targets when the laser-designator-repeater mode is not selected.

The embodiments described above in connection with FIGS. 3, 4A, 4B, 5, 6, 7A, and 7B are equally applicable to the second embodiment described above in connection with FIGS. 8A, 8B, and 9.

As in the above embodiments, it is preferred that the reflected energy of the laser appointer beam 102B is distinguishable from the solar-illuminated background. This can be accomplished by amplitude-modulating the laser transmitter 100 of the laser repeater system 98 to generate the laser appointer beam 102A at a frequency in the range of about 50-100 kHz, in order to provide a sufficient number of cycles (>>10) to be detected and recognized by the receiver channel. The desired amplitude modulation may be accomplished by causing the voltage of the drive signal to the laser diode to be varied by a sinusoidal function whose frequency is between 50 and 100 kHz. In alternative embodiments, the laser appointer beam 102A is phase-modulated or frequency-modulated in order to discern the appointer beam from background noise. When this amplitude modulated continuous wave (AMCW) signal is detected at the laser rangefinder receiver 40 in the avalanche photodiode detector, the detected signal is passed though several filters in parallel as shown below in FIG. 6. The AMCW laser appointer reflected signal 102B is passed through a band pass filter that is matched to the AMCW modulation rate of the laser designator (50 to 100 kHz). The pulsed laser rangefinder signal is passed through the 1 MHz to 40 MHz band pass filter that feeds the compute range module.

Figure 10:
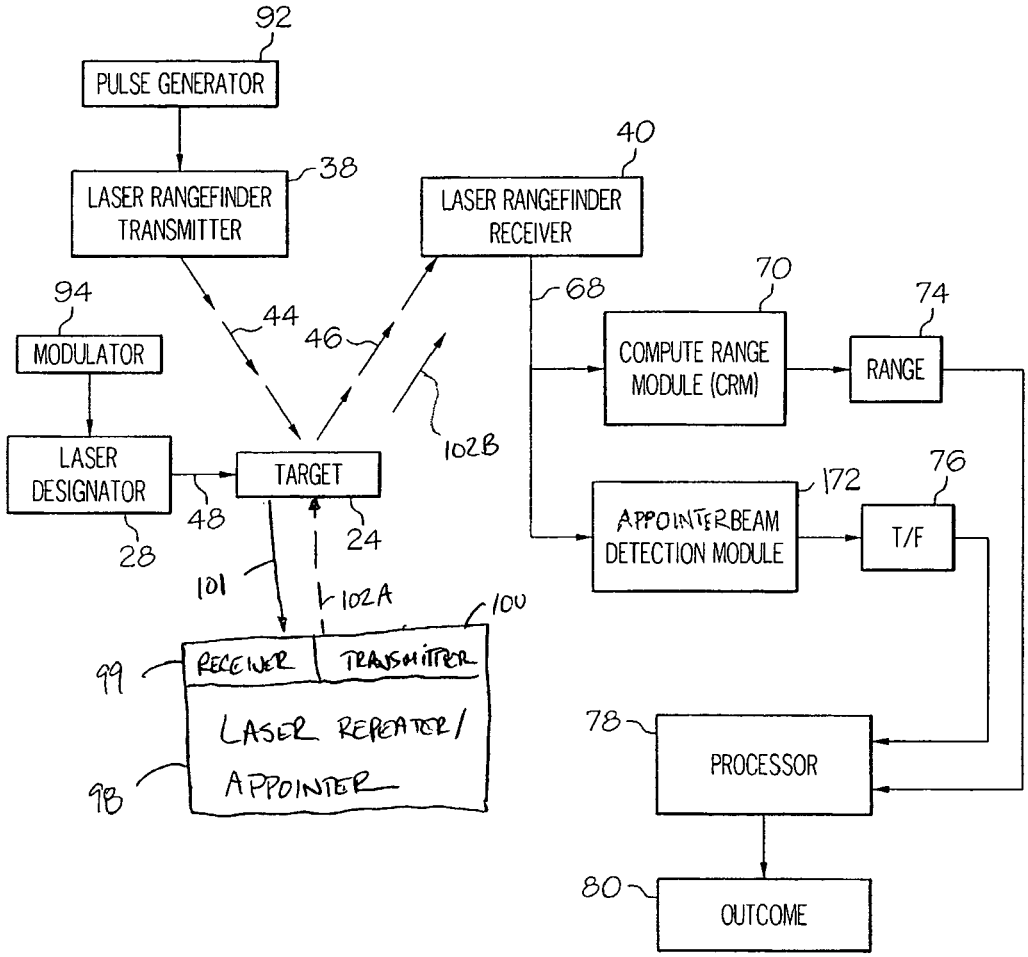
FIG. 10 is a system block diagram of the laser designator transmitter, the laser repeater system, the laser rangefinder transmitter, the laser rangefinder receiver, and the related processor in accordance with the second embodiment of the present invention.

FIG. 10 is a system block diagram of the laser designator transmitter, the laser repeater system, the laser rangefinder transmitter, the laser rangefinder receiver, and the related processor in accordance with the second embodiment of the present invention. In FIG. 6, a laser designator 28, which is situated on a separate platform from the munition, generates a continuous designator laser beam 48. The designator beam 48 is modulated by modulator 94, which, in one embodiment, provides amplitude modulation of the beam, as described above, and is directed at the target 24 to generate a designator beam spot 60 at the target 24. A portion of the designator beam 48 is reflected in a direction toward the laser repeater system 98 and detected at the laser repeater receiver 99. In response, the laser repeater transmitter 100 generates an appointer beam 102A that generates an appointer beam spot 160 is superimposed on the designator beam spot 60. From there, a portion of the appointer beam 102B is reflected in a direction toward the laser rangefinder receiver 40. At the same time, the laser rangefinder transmitter 38 of the sensor-fuzed munition generates a rangefinder beam 44 that is scanning the region of interest below the munition during its flight. The rangefinder beam 44 is pulsed by pulse generator 92 so that time-of-flight of the pulse can be measured for the purpose of range determination. The reflected rangefinder beam 46 is sensed by the laser rangefinder receiver and processed. A portion of the reflected energy of the appointer laser beam 102B is also received by the laser rangefinder receiver 40. The two received laser signals are nominally at the same optical wavelength (about 900 to 940 nanometers in this embodiment) and hence are passed through the same receive optics and detected in the same avalanche photodiode detector and converted to electrical signals. These two sets of electrical signals are each presented to two parallel bandpass filters which each pass one signal and not the other. The 50 kHz bandpass filter located in the appointer beam detection module 172 passes the appointer laser signal 102B component of the received signal 68 to the true/false ("T/F") processor 76 and rejects the reflected rangefinder beam component 46, while the 1 MHz to 40 MHz bandpass filter located in the compute range module 70 rejects the appointer laser signal component 102B and passes the reflected rangefinder beam component 46 along to the compute range module 70.

A compute range module (CRM) 70 processes the received signal 68, and computes the range 74 of the munition relative to the target 24, or relative to the ground surrounding the target 24, depending on the positioning of the field-of-view of the laser transmitter 38 and receiver 40 relative to the target 24. The determination of range 74 by the CRM is based on the time-of-flight (each additional 2 nanoseconds of elapsed time equals 1 foot of range) of the transmitted, reflected, and received rangefinder laser signal pulse 44, 46, and is computed according to conventional techniques.

An appointer beam detection module 172 that uses standard constant false alarm rate techniques also processes the received signal 68, and determines whether a reflected appointer beam 102B is present in the energy received at the laser rangefinder receiver 40. In one embodiment, the determination results in a true (laser appointer beam is present) or false (laser appointer beam is not present) reading 76.

The range information 74 and the true/false reading 76 are provided to the system processor 78 which generates an outcome 80 based on the information provided. In one embodiment, when operating in laser designator/appointer mode, a true reading 76 by the appointer beam detection module 172 is required before the warhead can be fired. In another embodiment, when operating in laser designator/appointer mode, a true reading 76 by the appointer beam detection module 172 results in a firing of the warhead, irrespective of the readings by the other sensor or sensors. In another embodiment, when operating in laser designator/appointer mode, a true reading 76 by the appointer beam detection module 172 results in the firing of the warhead only if readings by the other sensor or sensors confirm that such a firing should take place. In another embodiment, a false reading 76 by the appointer beam detection module 72 results in deactivation of the firing of the warhead, irrespective of the readings by the other sensor or sensors. In another embodiment, a false reading 76 by the appointer beam detection module 72 is taken into consideration by the processors, but a firing of the warhead can still occur if readings by the other sensor or sensors confirm that such a firing should take place. The processor 78 can be programmed to initiate any of a number of possible outcomes 80, including and beyond those exemplary embodiments mentioned above, in view of the detection or non-detection of the presence of the laser appointer beam on the anticipated target. The determination of the presence, or not, of the laser appointer beam on the target can be combined with the results of other sensors, including whether certain criteria concerning the target are met by the data collected by the passive infrared sensors on the munition, and whether certain criteria are met by the data collected by the active rangefinder 40 of the munition. Any logic combination can be conceived regarding these, and other, criteria in formulating a decision regarding engagement by the munition.

In various embodiments, the appointer beam transmitter 100 for illuminating the target with the appointer beam can optionally be provided from an air-based location, as shown, or, alternatively may be provided by other ground-based, water-based, air-based, or space-based locations.

While this invention has been particularly shown and described with references to preferred embodiments thereof, it will be understood by those skilled in the art that various changes in form and detail may be made herein without departing from the spirit and scope of the invention as defined by the appended claims.

What is claimed is:

1. A system for engaging a munition with a target, comprising:

an autonomous munition, including:

a rangefinder comprising:

a laser transmitter that transmits a first laser energy to a remote target;

a laser receiver that receives a reflected portion of the first laser energy as reflected by the remote target within a scanned field of view of the laser receiver and that receives a reflected portion of a second laser energy as reflected by the remote target within the scanned field of view of the laser receiver; and a range module that determines a range of the remote target from the reflected portion of the first laser energy; and an illumination module that determines whether the reflected portion of the second laser energy is present within the scanned field of view of the laser receiver;

a laser designator that generates third laser energy; and a laser repeater that receives the third laser energy as reflected by the remote target, and, in response, transmits the second laser energy to the remote target.

2. The system of claim 1 wherein the first laser energy and the second laser energy are of wavelengths that are substantially the same so that the laser receiver of the rangefinder can receive both the first laser energy and the second laser energy.

3. The system of claim 2 wherein the third laser energy is of a wavelength that is different than that of the first laser energy and the second laser energy.

4. The system of claim 1 wherein the first laser energy is pulsed and wherein the second laser energy is modulated.

5. The system of claim 1 wherein the laser repeater is located at an airborne delivery vehicle that delivers the autonomous munition.

6. The system of claim 1 wherein the third laser energy is incident at the remote target and illuminates a third laser energy spot on the remote target, and wherein the second laser energy is incident at the remote target and illuminates a second laser energy spot on the remote target.

7. The system of claim 6 wherein the second laser energy spot and the third laser energy spot overlap.

8. The system of claim 1 wherein the laser transmitter and laser receiver comprise a rangefinder for determining the range of the munition with respect to the target.

9. The system of claim 1 wherein the illumination module comprises a filter circuit that passes energy within an expected frequency band of the second laser energy.

10. The system of claim 1 wherein the second laser energy is modulated and wherein the illumination module includes a circuit that discriminates the second laser energy to determine whether the modulation in the second laser energy is present.

11. The system of claim 10 wherein the second laser energy is amplitude modulated.

12. The system of claim 10 wherein the second laser energy is phase modulated.

13. The system of claim 10 wherein the second laser energy is frequency modulated.

14. The system of claim 1 wherein the scanned field of view of the laser receiver translates in an inward-spiral scan pattern during operation of the munition.

15. The system of claim 14 wherein the inward-spiral scan pattern has an inter-scan spacing between adjacent spiral scan segments.

16. The system of claim 15 wherein the second laser energy is incident at the remote target and illuminates a spot of a width that is larger than the inter-scan spacing.

17. The system of claim 1 wherein the autonomous munition further comprises a warhead that is activated in response to whether the reflected portion of the second laser energy is present within the scanned field of view of the laser receiver.

18. The system of claim 1 wherein the autonomous munition further comprises a passive infrared receiver that receives infrared energy emitted by the remote target within a scanned field of view of the infrared receiver.

19. A method for engaging a munition with a target comprising:

transmitting first laser energy within a transmission field of view;

receiving a reflected signal including a reflected portion of the first laser energy as reflected by a remote target within a receiver field of view;

illuminating the remote target with a third laser energy;

detecting the illumination of the remote target by the third laser energy and illuminating the remote target with a second laser energy; and determining whether the reflected signal further includes a reflected portion of the second laser energy as reflected by the remote target within the receiver field of view, wherein the third laser energy is incident at the remote target and illuminates a third laser energy spot on the remote target, and wherein the second laser energy is incident at the remote target and illuminates a second laser energy spot on the remote target, and wherein the second laser energy spot and the third laser energy spot overlap.

20. The method of claim 19 wherein the first laser energy and the second laser energy are of wavelengths that are substantially the same.

21. The method of claim 20 wherein the third laser energy is of a wavelength that is different than that of the first laser energy and the second laser energy.

22. The method of claim 19 wherein detecting the illumination of the remote target occurs at an airborne delivery vehicle that delivers the munition at which the transmission of the first laser energy and the reception of the first and second laser energy occur.

23. The method of claim 19 further comprising engaging the target as a result of the step of determining.

24. The method of claim 23 wherein engaging the target comprises engaging the target when it is determined that the reflected signal includes the second laser energy.

25. The method of claim 23 wherein engaging the target comprises engaging the target with a warhead.

26. The method of claim 19 further comprising modulating the second laser energy for illuminating the remote target.

27. The method of claim 26 wherein determining comprises discriminating the second laser energy using a bandpass filter that is centered at a frequency equal to that of a modulation frequency of the second laser energy.

28. The method of claim 26 further comprising amplitude-modulating the second laser energy.

29. The method of claim 26 further comprising frequency-modulating the second laser energy.

30. The method of claim 26 further comprising phase-modulating the second laser energy.

31. The method of claim 19 wherein the receiver field of view translates in an inward-spiral scan pattern during operation of the munition.

32. The method of claim 31 wherein the inward-spiral scan pattern has an inter-scan spacing between adjacent spiral scan segments.

33. The method of claim 32 wherein illuminating comprises illuminating the remote target with the second laser energy of a spot size of a width that is larger than the inter-scan spacing.

34. The method of claim 19 further comprising receiving an infrared signal at a passive infrared receiver including infrared energy emitted by the remote target within a scanned field of view of the infrared receiver.

35. A method for engaging a munition with a target comprising:

transmitting first laser energy within a transmission field of view;

receiving a reflected signal including a reflected portion of the first laser energy as reflected by a remote target within a receiver field of view;

illuminating the remote target with a third laser energy;

detecting the illumination of the remote target by the third laser energy and illuminating the remote target with a second laser energy; and determining whether the reflected signal further includes a reflected portion of the second laser energy as reflected by the remote target within the receiver field of view, wherein detecting the illumination of the remote target occurs at an airborne delivery vehicle that delivers the munition at which the transmission of the first laser energy and the reception of the first and second laser energy occur.

36. A method for engaging a munition with a target comprising:

transmitting first laser energy within a transmission field of view;

receiving a reflected signal including a reflected portion of the first laser energy as reflected by a remote target within a receiver field of view;

illuminating the remote target with a third laser energy;

detecting the illumination of the remote target by the third laser energy and illuminating the remote target with a second laser energy; and determining whether the reflected signal further includes a reflected portion of the second laser energy as reflected by the remote target within the receiver field of view, wherein the receiver field of view translates in an inward-spiral scan pattern during operation of the munition, and wherein the inward-spiral scan pattern has an inter-scan spacing between adjacent spiral scan segments.

37. The method of claim 36 wherein illuminating comprises illuminating the remote target with the second laser energy of a spot size of a width that is larger than the inter-scan spacing.

* * * * *